United States Patent [19]

Miller

[11] 4,137,671

[45] Feb. 6, 1979

[54] STORM WINDOW LATCH MECHANISM

[76] Inventor: William C. Miller, 8934 Wilton Ave., Ellicott City, Md. 21043

[21] Appl. No.: 767,908

[22] Filed: Feb. 11, 1977

[51] Int. Cl.[2] ..... E05D 13/00

[52] U.S. Cl. ..... 49/417

[58] Field of Search ..... 49/417

[56] References Cited

U.S. PATENT DOCUMENTS

| | | | |
|---|---|---|---|
| 2,672,362 | 3/1954 | Aaynes | 292/66 |
| 2,731,287 | 1/1956 | Aaynes | 49/417 |
| 2,883,226 | 4/1959 | Aaynes | 49/417 |

*Primary Examiner*—Kenneth Downey

*Attorney, Agent, or Firm*—J. Wesley Everett

[57] ABSTRACT

A storm window latch mechanism which permits easy removal of a storm window sash when the latch mechanism is placed in one position and yet positively secures said storm window sash within the mounting framework when the latch mechanism is in a second position with freely slidable up and down movement being permitted. The latch mechanism includes a spring slider assembly having a low friction slide component mounted on the face thereof, with retention prongs provided on each of the respective ends of the spring member for engagement in appropriate apertures of the window sash, and a positive acting lever and bias spring structure connected to the middle portion of the resilient flexible spring member for actuation thereof. The lever portion is provided with two adjustment recesses which cooperate with a properly configured channel member mountable upon the edge channel of the window sash. A cooperating coil spring positively biases the latching lever into locked position whenever it is not being manipulated by an operator of the window sash. All of the components may be easily manufactured and assembled, and are relatively inexpensive.

1 Claim, 11 Drawing Figures

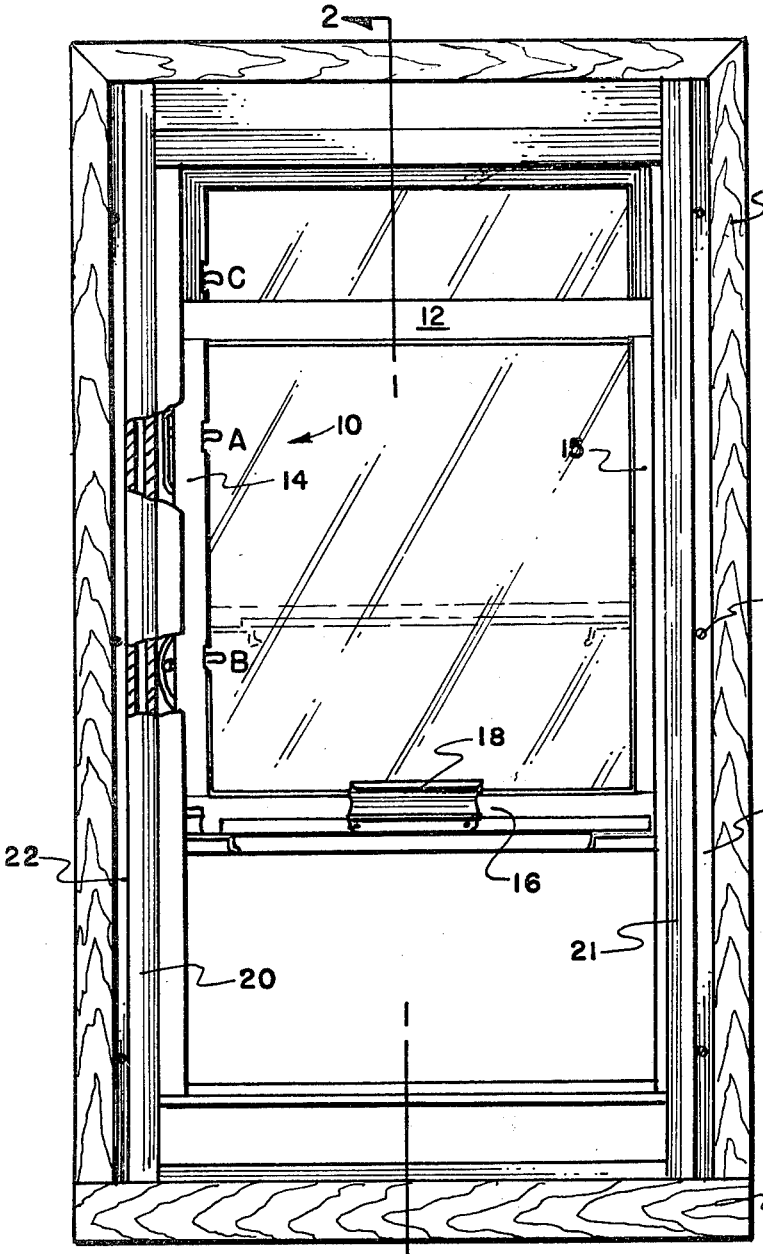
FIG. 1
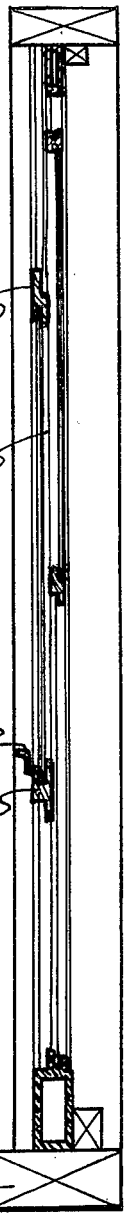
FIG. 2
FIG. 3
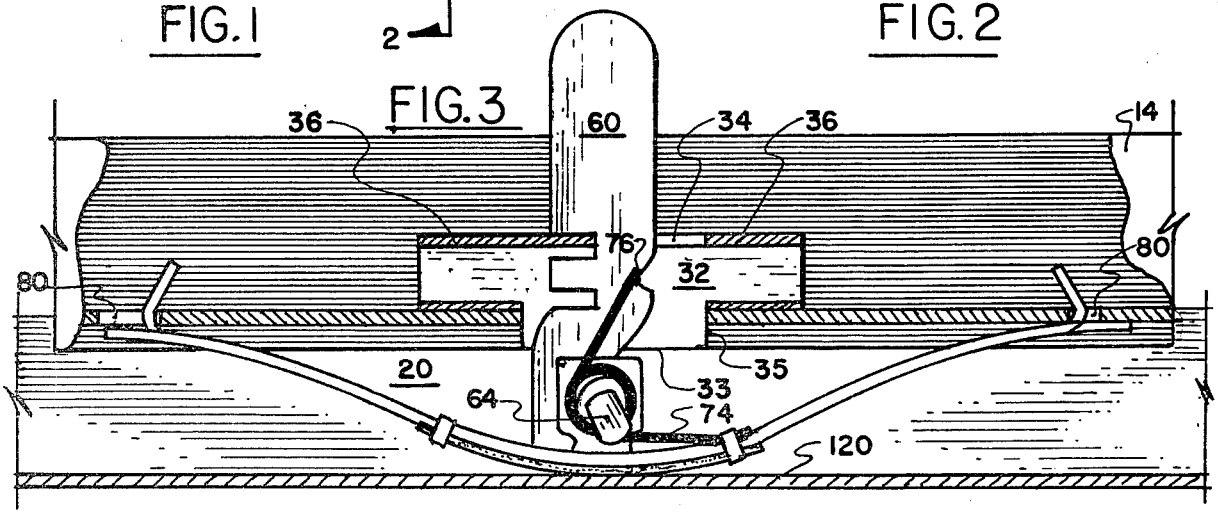

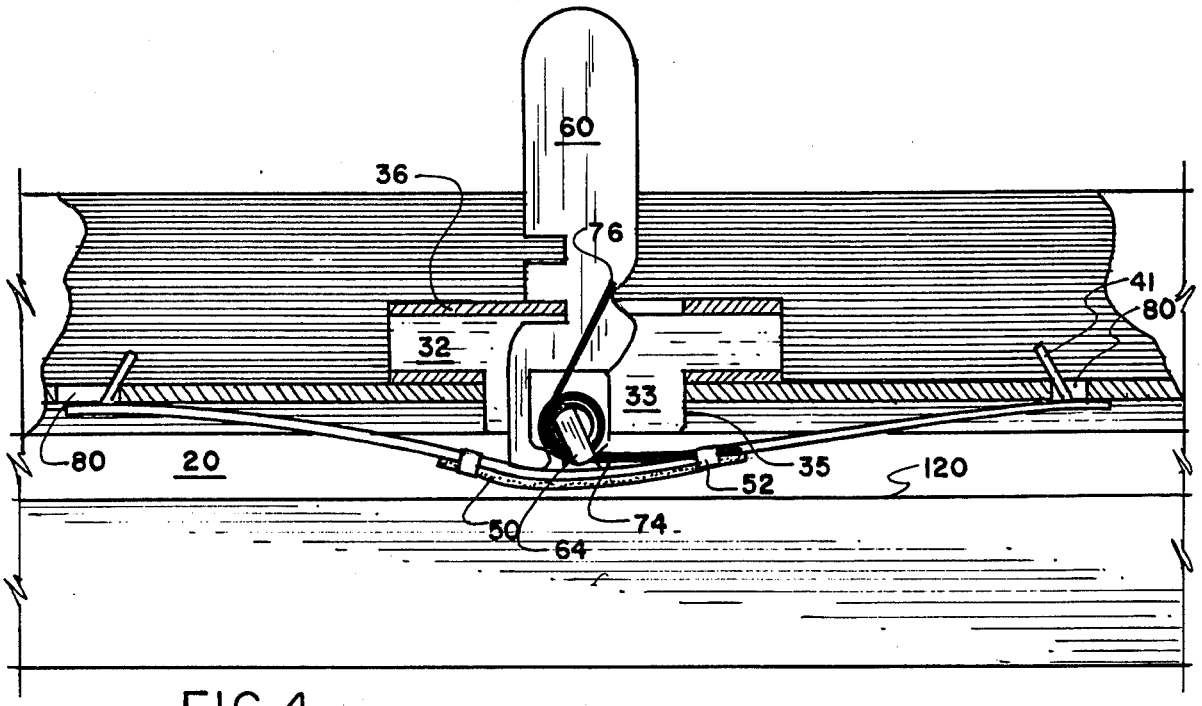
FIG. 4
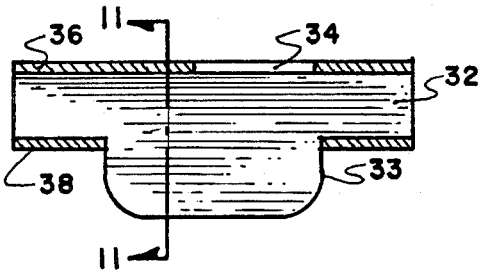
FIG. 10
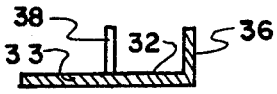
FIG. 11
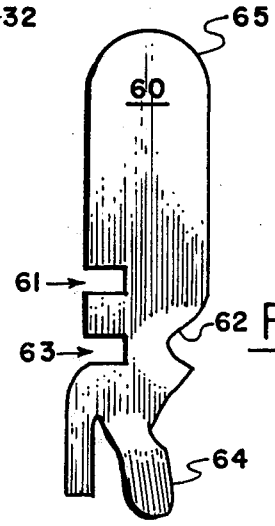
FIG. 5
FIG. 6
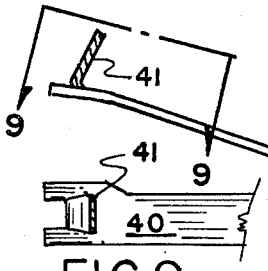
FIG. 9
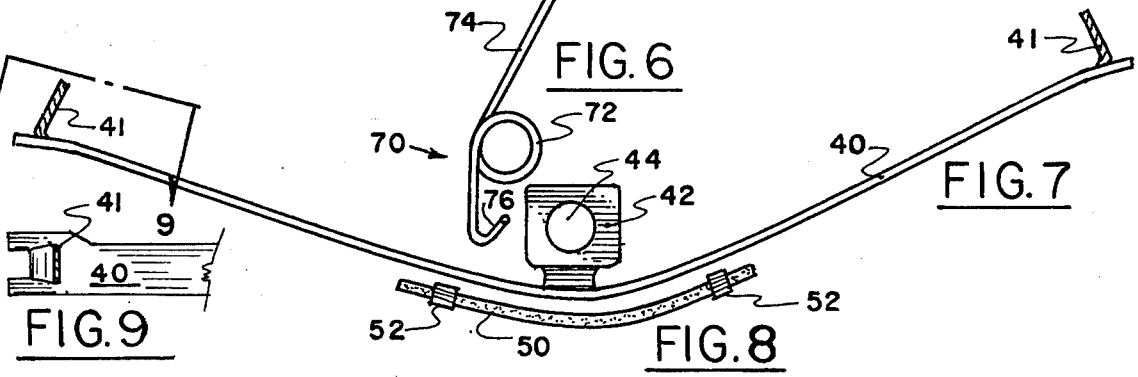
FIG. 7
FIG. 8

STORM WINDOW LATCH MECHANISM

BACKGROUND OF THE INVENTION

1. Field of the Invention

This invention relates generally to devices for latching window sash structures and especially to such devices which permit the easy removal of such sashes for cleaning and the like.

2. Description of the Prior Art

The common problem with known type devices for positively retaining storm window sashes and the like within their respective guide channels is that normally a user of the window, when attempting to remove the window sash from the window channels in which they are designed to move up and down therewithin, generally must compress a plurality of bias spring structures to a flattened position in order to remove the window sash. To flatten all such springs simultaneously is sometimes quite difficult to accomplish. Thus the removal of the window sash, which should be a simple procedure, is often more difficult than expected.

Another problem with known devices for latching and retaining storm sashes and the like within their respective channels is that the mechanism is unduly complicated and expensive. While a positive latch locking mechanism is highly desirable, either high expense or complicated structure often deter the use thereof.

Another problem with known type devices for permitting removal of storm window sashes and the like is that often times they are not positive in action, and therefore fail to operate in the intended manner.

None of the known prior art devices offers the new and unique features of the invention disclosed herein.

SUMMARY OF THE INVENTION

An object of the present invention is to provide a storm window latch mechanism which is positive in operation and simple to use and operate, relatively inexpensive to manufacture and install, and relatively uncomplicated in structure and of low maintenance requirements.

Another object of the present invention is to provide a window sash latch mechanism which has two operable positions, one position being in the fully expanded sash retention position while the other being in the fully retracted, sash removal position. The latch mechanism has a positive locking structure for each of the two positions.

A further object of the present invention is to provide a simple spring slide structure of a resilient nature with friction reducing components provided therewith for slidable engagement with a window sash guide channel, together with a pivotly mounted lever having two locking slots provided therein, which cooperates with a latch channel usable with the window sash rail and together with a bias spring, positively lock the spring slide member in one of two positions.

A still further object of the present invention is to provide a latch mechanism for use with window sash and the like which may be easily fabricated from sheet metal material on a mass production basis with standard type production machinery at a relatively low cost. The component units of the latch mechanism may be easily combined and installed with existing type window sash units with only slight modification thereto.

The storm window latch mechanism of this invention as disclosed herein offers a number of new and unique features not heretofore found in the art. The latch mechanism basically consists of a resilient, flexible slide spring member mounted on an external edge of a conventional window sash unit and engageable with the inner channel of conventional type channel guide members. These guide channels permit the window sash units to slide up and down therewithin and normally are provided with additional structure to permit the sash to be locked in position at several points of opening thereof. With such type window sash units it is highly desirable that the sash units themselves be easily and quickly removable for the purpose of cleaning and the like. This is generally accomplished by pushing against the resilient spring members aligned along one vertical rail of the window unit in order to compress same and thus decrease the overall width of the window unit in order that it will clear the inside edge of the opposite vertical window rail and permit the sash to clear the same and be removed. However, the problem with this type window removal procedure is that all of the spring mechanisms have to be compressed simultaneously in order for the sash to be removed. This can be quite difficult at times especially for older people or others without a lot of strength. Thus it is highly desirable that a positive latch mechanism be provided for holding the resilient spring members in a retracted position to permit the window sash to be easily removed from the window frame.

This is accomplished in this invention by having a pivotly mounted lever which has two adjustment positions provided by slots traverse of the lever axis which engage with a simple channel member which may be easily added to the window sash side channel. A pivot spring associated with the lever and the resilient slide spring assure that the lever will remain in either latched position once adjusted and placed thereinto. The resilient slide spring also is provided with a friction reducing component to decrease the sliding resistance as exists at the inside of the window channel rails in the normal sash retention position of the latch mechanism.

All of the component units of the latch mechanism of this invention may be easily fabricated from sheet metal material, spring material, and low friction material such as teflon or the like. Once fabricated the mechanism may be quickly and easily installed in convention type window sash units with a minimum of time and expense. The structure is of such a simple nature that it could even be supplied as a kit item for installation by home-users and how-to-do-it-yourselfers.

These together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a front elevational view of a storm window structure mounted in a conventional house window frame having the latch mechanism of this invention installed therewith and indicated by broken portions.

FIG. 2 is a side elevational view, partly in cross section, taken generally along line 2—2 of FIG. 1.

FIG. 3 is an enlarged detail view of the latch mechanism of this invention with the spring latched in slide position.

FIG. 4 is an enlarged detail of the latch mechanism with the spring in the retracted window sash removal position.

FIG. 5 is a plan view of the latch lever component per se.

FIG. 6 is a plan view of the bias spring component per se.

FIG. 7 is a side view of the resilient flexible slide spring component per se.

FIG. 8 is a side view of the friction reducing slide component per se.

FIG. 9 is a detail view taken generally along line 9—9 of FIG. 7.

FIG. 10 is a side view of the latch mechanism bracket per se.

FIG. 11 is a cross sectional view taken generally along line 11—11 of FIG. 10.

DESCRIPTION OF THE PREFERRED EMBODIMENT

Referring to FIG. 1 of the drawings, reference numeral 10 indicates in general the latch mechanism of this invention as installed on a conventional type window sash for a storm window insert or the like. As seen in this view, the storm window sash has a horizontal top rail 12 and a horizontal bottom rail 16 together with vertical side rails 14 and 15. Such sash units are well-known and are generally provided with glass or screen inserts. These sash units are designed to slide within vertical guide channels or tracks 20 and 21 of the insert frames which may be fastened within conventional type house window frames. Normally extending flanges 22 and 23 are provided as part of the vertical channel members 20 and 21, and these flanges are secured to the house window frame by appropriate screws 25. The house window frame is indicated generally by reference numeral 26. A handle such as 18 may also be provided for some or all of the window sash units.

Normally the window sash units are provided with resilient slide springs commonly mounted along the left vertical window rail 14. These commonly would be arranged as shown in the view of FIG. 1 at A, B and C. In present type window sash units merely provided with resilient slide springs, in order to remove the sash both of the spring portions at A and B would have to be compressed simultaneously in order to provide enough clearance for the right vertical rail 15 to clear the vertical guide channel 21 to permit the outward movement thereof for the complete removal of the sash. However, with the latch mechanism of this invention, each of the resilient slide springs may be latched to a retracted position as shown by reference A, and the window may be easily removed without a great effort on the part of the user.

The new and unique mechanism for effecting this desired function will now be described in detail. Looking at FIGS. 3–11 the components of the latch mechanism may be seen. FIG. 5 shows the lever member 60 preferably made of metal and of relatively flat form. Provided near the central portion thereof are two elongated slots 61 and 63 and on the opposite edge from the slots is a recess 62. The rounded end 65 is only used as the handle portion while the opposite end 64 is deformed laterally to provide a pivot and spring retention tab.

Reference numeral 70 of FIG. 6 indicates in general the bias pivot spring used to positively retain the latch lever 60 in one of the two locked positions. This spring member has several spring convolutions 72 and is provided at one end with a straight portion 74 and at the other end with a hooked portion 76.

FIG. 7 shows the flexible and resilient window sash slide spring 40 with spring retention tabs 41 provided at each of the ends thereof, and a central tab 42 provided with a central aperture 44 therewithin for association with the latch lever 60 and the bias pivot spring 70.

FIG. 8 shows the low friction slide component 50 with suitable attaching tabs 52 associated therewith. This friction reducing slide member 50 may be made of "Teflon" or of other low friction plastic or like materials.

FIGS. 10 and 11 show the latch mechanism retaining body member which preferably is also formed of metal material and consists of a body plate 32 having a flange 36 along one edge thereof and a central projection 33 extending from the other edge thereof. On each side of the central projection 33 the body plate 32 also is provided with upward extending flanges 38 as best seen in FIG. 11. A slot 34 also is provided beginning at the center of flange 36 and extending towards one end of said flange as seen in FIG. 10.

These component units are assembled together with the window sash side rail 14 as best seen in FIGS. 3 and 4. The main body member 32 is inserted through an elongated slot 35 provided in the outer side of the rail 14. Slot 35 is preferably of a slightly larger size than the width of the projection 33 of the main body member. After inserting the projection 33 of the main body member through the slot 35, then the lever member 60 is attached to the resilient slide spring 40 by inserting the projecting tab 64 through the hole 44 of tab 42. Simultaneously with this the convolutions 72 of the bias pivot spring 70 are inserted over the tab 64 with the hook end 76 meeting and engaging with the recess 62 of the lever. The other straight end portion 74 engages with the inner surface of the resilient flexible spring 40 and is retained in aligned position therewith by one of the tabs 52 as used to retain the friction reducing slide component 50 on the outer side of the resilient flexible spring member. This assembled spring and lever with bias spring structure is then assembled in the sash rail and through the main body member by inserting one of the tabs 41 through one of the slots 80 provided in the outer sash rail and then the end 65 of pivot lever 60 is inserted through aperture 35 on top of projection 33 in main body portion 32. It in turn then is pushed through the aperture 34 of the main body member for extension beyond the window rail 14 with sufficient protrusion thereof to form an easy portion for gripping by the user of the device. The other end of the flexible spring 40 has the tab 41 inserted through the other slot 80 for completion of the assembly.

Now looking at FIG. 3, when the lever 60 is pivoted around the pivot point formed by tab 64 in aperture 44 against the bias of spring 70, the slot 61 will be in engagement with flange portion 36. This will positively lock the resilient slide spring 40, 50 against the inner surface 120 of the vertical window mount 20 so that the sash will be freely slidable up and down and constrained within the channels without any danger of inadvertent disengagement from the window channels. However, when it is desired to quickly and easily remove the window sash, the lever 60 is again pivoted about point 44, 64, and the structure moved in the direction to retract flexible slide spring 40 and slide member 50 and then the lever locked with slot 63 in engagement with flange 36 as seen in FIG. 4. Thus, as can be easily visualized, the mechanism of this invention positively latches the slide spring mechanism in one of the two operating positions.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A window retaining and releasing means for retaining and releasing a window sash from a window frame wherein the window sash is provided with a resilient leaf spring type urging means for urging the sash to one side of the window frame for retaining the sash therein, a latch lever being attached centrally of the resilient urging means having means positioned on said latch lever for holding the resilient urging means in a collapsed position, the improvement comprising, said latch lever having an off-set (64) adjacent its outer end and the outer end of the offset extending downwardly substantially parallel with the plane of the inner portion of the latch lever, said latch lever having at least two slots extending inwardly of the lever perpendicular to the longitudinal axis of the said latch lever, the inner slot positioned to engage a latch lever receiving element for retaining the resilient member in extended position, the second slot positioned outwardly from the first slot and positioned to fix the resilient means adjacent the sash frame for removing the said sash from the window frame.

* * * * *